US005816849A

United States Patent [19]

Schmidt

[11] Patent Number: 5,816,849

[45] **Date of Patent: *Oct. 6, 1998**

[54] ADJUSTABLE CHRISTMAS LIGHT SYSTEM

[76] Inventor: Richard Allen Schmidt, 904 E. Cedar St., Marcus, Iowa 51035

[ * ] Notice: This patent issued on a continued prosecution application filed under 37 CFR 1.53(d), and is subject to the twenty year patent term provisions of 35 U.S.C. 154(a)(2).

[21] Appl. No.: 738,398

[22] Filed: Oct. 25, 1996

[51] Int. Cl.[6] ..... H01R 11/00

[52] U.S. Cl. ..... 439/505; 439/679

[58] Field of Search ..... 439/679, 505

[56] References Cited

U.S. PATENT DOCUMENTS

| | | | |
|---|---|---|---|
| 1,843,389 | 2/1932 | Fischer | 439/505 |
| 2,572,382 | 10/1951 | Peterson | 439/505 |
| 2,795,768 | 6/1957 | Duckworth et al. | 439/505 |
| 3,039,075 | 6/1962 | Stollman | 439/679 |
| 3,149,898 | 9/1964 | Klumpp, Jr. | 439/679 |
| 3,504,169 | 3/1970 | Freeburger | 439/505 |
| 4,667,276 | 5/1987 | Cheng | 439/505 |

*Primary Examiner*—Neil Abrams
*Assistant Examiner*—Brian J. Biggi

[57] ABSTRACT

A new Adjustable Christmas Light System for providing a lighting system which allows the user to adjustably determine the length for a specific situation and for providing a plurality of sections which may be removed upon malfunctioning. The inventive device includes a length of wire strand forming a section, at least one light connected in series within the wire strand, a female connector electrically connected at one end of the wire strand, and a male connector electrically connected to the wire strand opposite of the female connector where the female connector electrically receives a male connector from another section.

8 Claims, 2 Drawing Sheets

ADJUSTABLE CHRISTMAS LIGHT SYSTEM

BACKGROUND OF THE INVENTION

1. Field of the Invention

The present invention relates to Lighting Devices and more particularly pertains to a new Adjustable Christmas Light System for providing a lighting system which allows the user to adjustably determine the length for a specific situation and for providing a plurality of sections which may be removed upon malfunctioning.

2. Description of the Prior Art

The use of Lighting Devices is known in the prior art. More specifically, Lighting Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Lighting Devices include U.S. Pat. No. 5,150,964; U.S. Pat. No. 4,870,547; U.S. Pat. No. 4,005,923; U.S. Design Pat. No. 351,915; U.S. Pat. No. 4,544,218 and U.S. Pat. No. 5,381,899.

While these devices fulfill their respective, particular objectives and requirements, the aforementioned patents do not disclose a new Adjustable Christmas Light System. The inventive device includes a length of wire strand forming a section, at least one light connected in series within the wire strand, a female connector electrically connected at one end of the wire strand, and a male connector electrically connected to the wire strand opposite of the female connector where the female connector electrically receives a male connector from another section.

In these respects, the Adjustable Christmas Light System according to the present invention substantially departs from the conventional concepts and designs of the prior art, and in so doing provides an apparatus primarily developed for the purpose of providing a lighting system which allows the user to adjustably determine the length for a specific situation and for providing a plurality of sections which may be removed upon malfunctioning.

SUMMARY OF THE INVENTION

In view of the foregoing disadvantages inherent in the known types of Lighting Devices now present in the prior art, the present invention provides a new Adjustable Christmas Light System construction wherein the same can be utilized for providing a lighting system which allows the user to adjustably determine the length for a specific situation and for providing a plurality of sections which may be removed upon malfunctioning.

The general purpose of the present invention, which will be described subsequently in greater detail, is to provide a new Adjustable Christmas Light System apparatus and method which has many of the advantages of the Lighting Devices mentioned heretofore and many novel features that result in a new Adjustable Christmas Light System which is not anticipated, rendered obvious, suggested, or even implied by any of the prior art Lighting Devices, either alone or in any combination thereof.

To attain this, the present invention generally comprises a length of wire strand forming a section, at least one light connected in series within the wire strand, a female connector electrically connected at one end of the wire strand, and a male connector electrically connected to the wire strand opposite of the female connector where the female connector electrically receives a male connector from another section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Adjustable Christmas Light System apparatus and method which has many of the advantages of the Lighting Devices mentioned heretofore and many novel features that result in a new Adjustable Christmas Light System which is not anticipated, rendered obvious, suggested, or even implied by any of the prior art Lighting Devices, either alone or in any combination thereof.

It is another object of the present invention to provide a new Adjustable Christmas Light System which may be easily and efficiently manufactured and marketed.

It is a further object of the present invention to provide a new Adjustable Christmas Light System which is of a durable and reliable construction.

An even further object of the present invention is to provide a new Adjustable Christmas Light System which is susceptible of a low cost of manufacture with regard to both materials and labor, and which accordingly is then susceptible of low prices of sale to the consuming public, thereby making such Adjustable Christmas Light System economically available to the buying public.

Still yet another object of the present invention is to provide a new Adjustable Christmas Light System which provides in the apparatuses and methods of the prior art some of the advantages thereof, while simultaneously overcoming some of the disadvantages normally associated therewith.

Still another object of the present invention is to provide a new Adjustable Christmas Light System for providing a lighting system which allows the user to adjustably determine the length for a specific situation and for providing a plurality of sections which may be removed upon malfunctioning.

Yet another object of the present invention is to provide a new Adjustable Christmas Light System which includes a length of wire strand forming a section, at least one light connected in series within the wire strand, a female connector electrically connected at one end of the wire strand, and a male connector electrically connected to the wire strand opposite of the female connector where the female connector electrically receives a male connector from another section.

Still yet another object of the present invention is to provide a new Adjustable Christmas Light System that allows only a section of the lights to be discard upon malfunctioning instead of the entire strand of lights.

Even still another object of the present invention is to provide a new Adjustable Christmas Light System that allows the user to adjust the length of the strand to a desired length.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
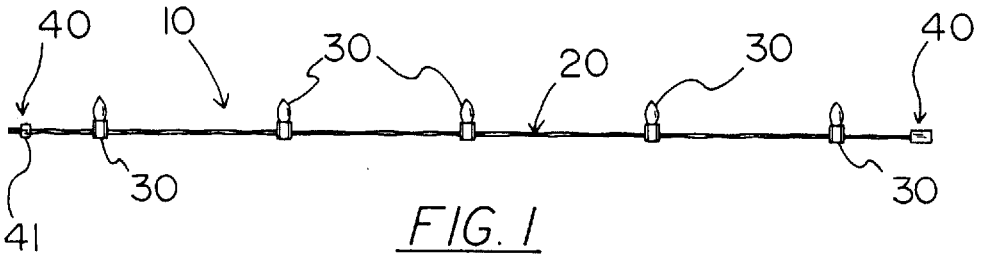
FIG. 1 is a side view of a new Adjustable Christmas Light System according to the present invention.
Figure 2:
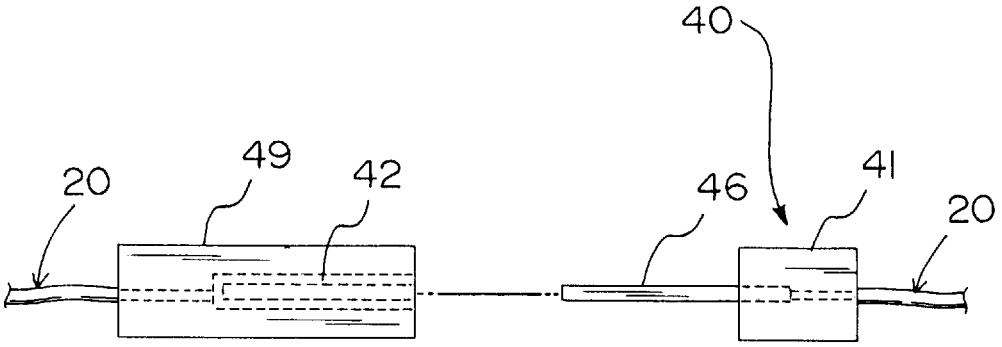
FIG. 2 is an exploded side view of the connecting means.

With reference now to the drawings, and in particular to FIGS. 1 through 6 thereof, a new Adjustable Christmas Light System embodying the principles and concepts of the present invention and generally designated by the reference numeral 10 will be described.

More specifically, it will be noted that the Adjustable Christmas Light System 10 comprises a length of wire strand 20 forming a section, at least one light 30 connected in series within the wire strand 20, a female connector 42, 44 electrically connected at one end of the wire strand 20, and a male connector 46, 48 electrically connected to the wire strand 20 opposite of the female connector 42, 44 where the female connector 42, 44 electrically receives a male connector 46, 48 from another section.

Figure 3:
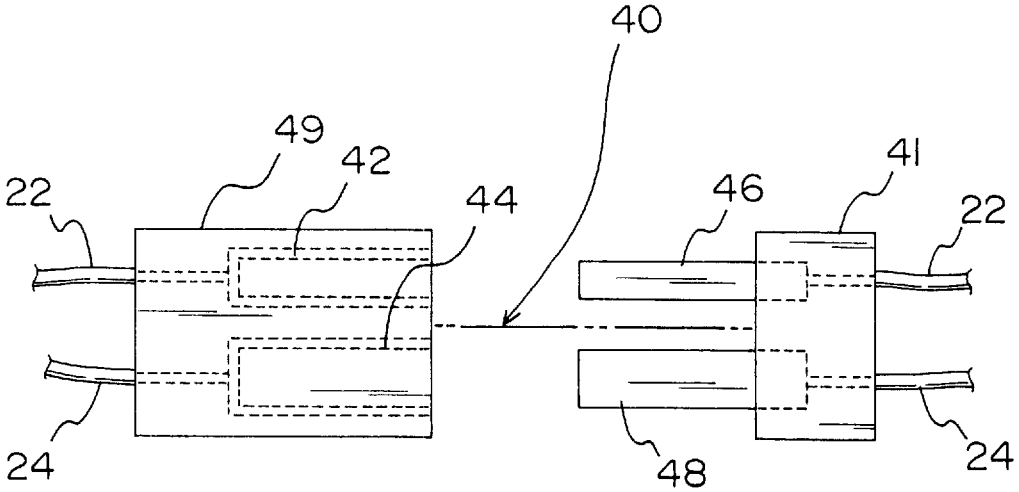
FIG. 3 is an exploded top view of the connecting means.
Figure 4:
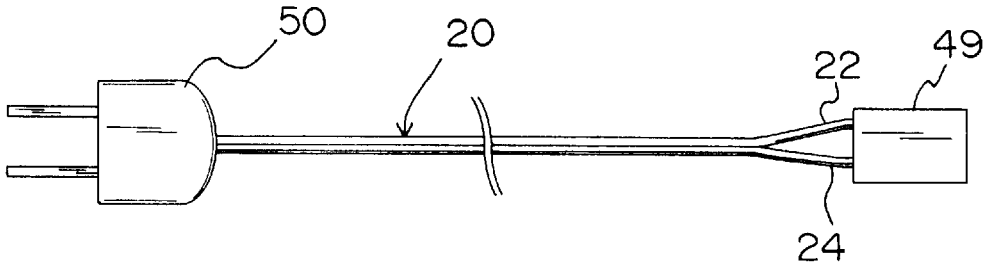
FIG. 4 is a top view of the AC plug.

As best illustrated in FIGS. 1 through 6, it can be shown that the plurality of wire sections are electrically coupleable to one another allowing selective sizing of the present invention. The wire section comprises a wire strand 20 having a first wire 22 and a second wire 24 as best shown in FIG. 3. At least one light 30 is electrically coupled in parallel within the wire strand 20.

Figure 5:
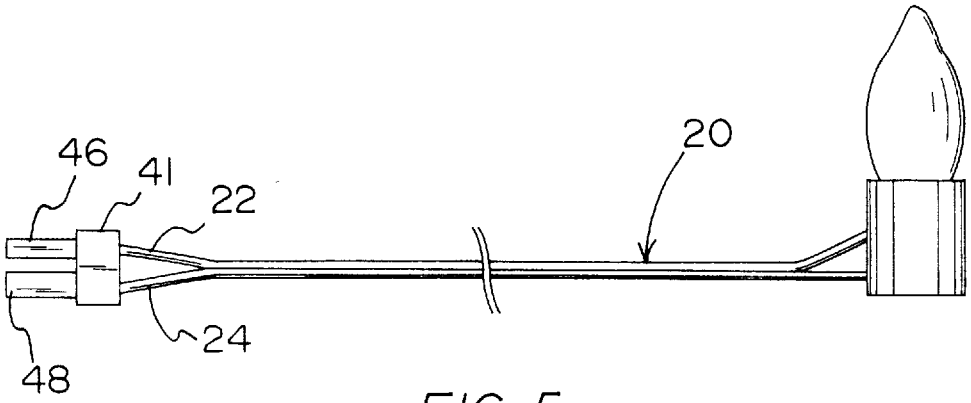
FIG. 5 is a top view of the end of the wire strand.
Figure 6:
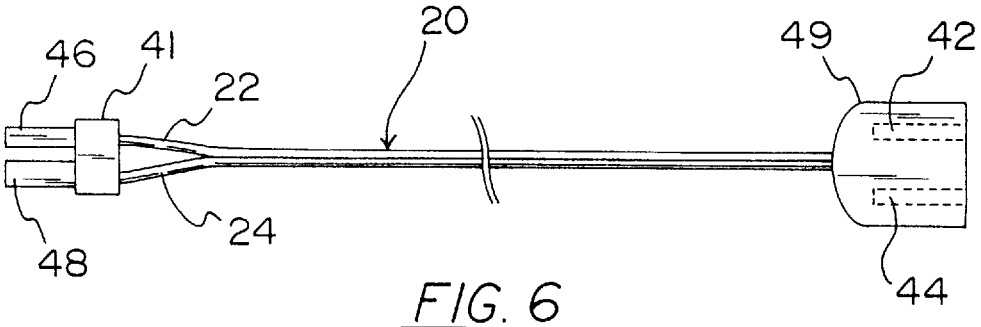
FIG. 6 is a top view of the present invention.

As shown in FIG. 1, a connecting means 40 is electrically coupled to opposing ends of the wire strand 20, where the connecting means 40 electrically couples to another connecting means 40 of another wire strand 20. The connecting means 40 comprises a first insulator 41 secured at one end of the wire strand 20. A second insulator 49 is secured to the wire strand 20 opposite of the first insulator 41 as shown in FIG. 3. A first male connector 46 is secured within the first insulator 41 and electrically coupled to the first wire 22. A second male connector 48 is secured within the first insulator 41 and electrically coupled to the second wire 24. A first female connector 42 is secured within the second insulator 49 and electrically coupled to the first wire 22 opposite of the first male connector 46. The first female connector 44 receives a first male connector 46 from another wire strand 20. A second female connector 44 is secured within the second insulator 49 and is electrically coupled to the second wire 24 opposite of the second male connector 48. The second female connector 44 receives a second male connector 48 from another wire strand 20. Preferably as shown in FIGS. 1, 5 and 6, the first male connector 46 is narrower than the second male connector 48. The first female connector 44 is preferably narrower than the second female connector 44 to allow connection of the male connectors 46, 48 with the female connectors 42, 44 in one position as shown in FIG. 3 of the drawings.

In use, when a section of the present invention malfunctions, only that section needs to be removed instead of the entire length of wire. Also, the user may add as many sections to achieve the desired length of lighting. The user may remove a section by decoupling the male connectors 46, 48 from within the female connectors 42, 44 at both ends of the malfunctioning section. The user thereafter couples the decoupled male connectors 46, 48 from the functioning section with the decoupled female connectors 42, 44 from the functioning section.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable Christmas light system comprising:

a plurality of wire segments electrically coupleable to one another, each wire segment comprising a wire strand having a first wire and a second wire;

at least one of said wire segments comprising a socket segment having a light bulb socket electrically connected to the first and second wires of said socket segment, one end of said socket segment with a light bulb socket having a first insulated connector;

at least one of said wire segments comprising a plug segment having a plug adapted for inserting into a plug receptacle, said plug having first and second male connectors, said first male connector being electrically connected to said first wire and said second male connector being electrically connected to said second wire, one end of said plug segment having a second insulated connector, said plug segment being directly connectable to said socket segment;

at least one of said wire segments comprising a receptacle segment having a plug receptacle adapted for receiving the male connectors of a plug and being electrically connected to the first and second wires of said receptacle segment, one end of said receptacle segment having a first insulated connector, said receptacle segment being directly connectable to said socket segment;

said first insulated connector including a first planar male connector secured within said first insulated connector and electrically coupled to said first wire;

said first insulated connector including a second planar male connector secured within said first insulated connector and electrically coupled to said second wire, said second planar male connector being coplanar with said first planar male connector;

said second insulated connector including a first female connector secured within said second insulated connector and electrically coupled to said first wire, wherein said first female connector is adapted to receive a first planar male connector from the first insulated connector of another wire strand; and said second insulated connector including a second female connector secured within said second insulated connector and electrically coupled to said second wire, wherein said second female connector is adapted to receive a second planar male connector of the first insulated connector of another wire strand;

wherein the first insulated connector of one of said wire segments is connectable to the second insulated connector of another of said wire segments to form a chain of said wire segments of adjustable length with a plug at one end of said chain and a plug receptacle at another end of said chain.

2. The adjustable Christmas light system of claim 1, wherein said first male connector is narrower than said second male connector, and where said first female connector is narrower than said second female connector to allow connection of said male connectors with said female connectors in one position.

3. The adjustable Christmas light system of claim 2, wherein the first and the second planar male connectors have a uniform cross section throughout a length of the respective connector.

4. The adjustable Christmas light system of claim 3, including five wire segments with light bulb sockets electrically coupled together.

5. The light system of claim 1 wherein said socket segment has the light bulb socket positioned at substantially one end of the wire strand of said socket segment.

6. The light system of claim 1 wherein said second insulated connector is sheathed so as to prevent unintentional contact with the female connectors attached to said first and second wires of said wire strand.

7. An adjustable Christmas light system comprising:

a plurality of wire segments electrically coupleable to one another, each wire segment comprising a wire strand having a first wire and a second wire;

at least one of said wire segments comprising a socket segment having a light bulb socket electrically connected to the first and second wires of said socket segment, one end of said socket segment with a light bulb socket having a first insulated connector;

at least one of said wire segments comprising a plug segment having a plug adapted for inserting into a plug receptacle, said plug having first and second male connectors, said first male connector being electrically connected to said first wire and said second male connector being electrically connected to said second wire, one end of said plug segment having a second insulated connector;

at least one of said wire segments comprising a receptacle segment having a plug receptacle adapted for receiving the male connectors of a plug and being electrically connected to the first and second wires of said receptacle segment, one end of said receptacle segment having a first insulated connector;

said first insulated connector including a first planar male connector secured within said first insulated connector and electrically coupled to said first wire;

said first insulated connector including a second planar male connector secured within said first insulated connector and electrically coupled to said second wire, said second planar male connector being coplanar with said first planar male connector;

said second insulated connector including a first female connector secured within said second insulated connector and electrically coupled to said first wire, wherein said first female connector is adapted to receive a first planar male connector from the first insulated connector of another wire strand; and said second insulated connector including a second female connector secured within said second insulated connector and electrically coupled to said second wire, wherein said second female connector is adapted to receive a second planar male connector of the first insulated connector of another wire strand;

wherein the first insulated connector of one of said wire segments is connectable to the second insulated connector of another of said wire segments to form a chain of said wire segments of adjustable length with a plug at one end of said chain and a plug receptacle at another end of said chain;

wherein said first male connector is narrower than said second male connector, and where said first female connector is narrower than said second female connector to allow connection of said male connectors with said female connectors in one position; and wherein the first and the second planar male connectors have a uniform cross section throughout a length of the respective connector.

8. A kit for forming a decorative light string of adjustable length, comprising:

a plurality of light string segments, each of said light string segments comprising a pair of wire conductors coupled together;

one of said light string segments comprising a socket segment having a single light bulb socket electrically connected to the pair of wire conductors of said socket segment, each of said socket segments having a length substantially equal to the other of said socket segments, one end of said socket segment with a light bulb socket having a first insulated connector;

at least three of said light string segments comprising a plug segment having, a plug adapted for inserting into a plug receptacle, said plug being electrically connected to the pair of wire conductors, one end of said plug segment having a second insulated connector;

one of said light string segments comprising a receptacle segment having a plug receptacle adapted for receiving the male connectors of a plug and being electrically connected to the pair of wire connectors of said receptacle segment, one end of said receptacle segment having a first insulated connector;

wherein the first insulated connector of one of said light string segments is connectable to the second insulated connector of another of said light string segments to form a chain of said light string segments of variable and adjustable length and number of light bulb sockets with a plug at one end of said chain and a plug receptacle at another end of said chain.

* * * * *